US011308868B2

(12) United States Patent
Stan et al.

(10) Patent No.: US 11,308,868 B2
(45) Date of Patent: Apr. 19, 2022

(54) METHODS AND APPARATUS FOR UTILIZING DISPLAY CORRECTION FACTORS

(71) Applicant: QUALCOMM Incorporated, San Diego, CA (US)

(72) Inventors: Daniel Stan, Richmond Hill (CA); Natan Jacobson, San Diego, CA (US); Ike Ikizyan, San Diego, CA (US); Mark Sternberg, Toronto (CA); Paul Wiercienski, Toronto (CA)

(73) Assignee: QUALCOMM Incorporated, San Diego, CA (US)

( * ) Notice: Subject to any disclaimer, the term of this patent is extended or adjusted under 35 U.S.C. 154(b) by 51 days.

(21) Appl. No.: 16/734,112

(22) Filed: Jan. 3, 2020

(65) Prior Publication Data

US 2021/0210007 A1 Jul. 8, 2021

(51) Int. Cl.
*G09G 3/3208* (2016.01)

(52) U.S. Cl.
CPC ... *G09G 3/3208* (2013.01); *G09G 2320/0233* (2013.01); *G09G 2320/0242* (2013.01); *G09G 2360/144* (2013.01); *G09G 2360/147* (2013.01); *G09G 2360/16* (2013.01)

(58) Field of Classification Search
CPC ..... G09G 3/3208
See application file for complete search history.

(56) References Cited

U.S. PATENT DOCUMENTS

| | | | | |
|---|---|---|---|---|
| 6,260,038 | B1 * | 7/2001 | Martin | G06K 9/6218 |
| 2010/0008591 | A1 * | 1/2010 | Su | H04N 17/00 382/232 |
| 2014/0009484 | A1 * | 1/2014 | Suyama | G06T 11/001 345/589 |
| 2015/0187306 | A1 | 7/2015 | Syu et al. | |
| 2016/0219180 | A1 * | 7/2016 | Shinba | G09G 3/30 |
| 2016/0366444 | A1 | 12/2016 | Sullivan | |

OTHER PUBLICATIONS

International Search Report and Written Opinion—PCT/US2020/062894—ISA/EPO—dated Mar. 15, 2021.

* cited by examiner

*Primary Examiner* — Gustavo Polo
(74) *Attorney, Agent, or Firm* — Campbell C. Chiang; Procopio, Cory, Hargreaves & Savitch LLP

(57) ABSTRACT

The present disclosure relates to methods and apparatus for display processing. In some aspects, the apparatus can measure at least one panel including one or more panel measurements. The apparatus can also determine at least one correction factor for each of the one or more panel measurements. Further, the apparatus can adjust the at least one correction factor based on each of the one or more panel measurements. In some aspects, the apparatus can compress the at least one correction factor based on each of the one or more panel measurements. Moreover, the apparatus can store the compressed at least one correction factor. In some aspects, the apparatus can decode correction data for at least one frame based on the adjusted at least one correction factor. The apparatus can also store or communicate the decoded correction data for the at least one frame.

52 Claims, 6 Drawing Sheets

METHODS AND APPARATUS FOR UTILIZING DISPLAY CORRECTION FACTORS

TECHNICAL FIELD

The present disclosure relates generally to processing systems and, more particularly, to one or more techniques for display processing.

INTRODUCTION

Computing devices often utilize a graphics processing unit (GPU) to accelerate the rendering of graphical data for display. Such computing devices may include, for example, computer workstations, mobile phones such as so-called smartphones, embedded systems, personal computers, tablet computers, and video game consoles. GPUs execute a graphics processing pipeline that includes one or more processing stages that operate together to execute graphics processing commands and output a frame. A central processing unit (CPU) may control the operation of the GPU by issuing one or more graphics processing commands to the GPU. Modern day CPUs are typically capable of concurrently executing multiple applications, each of which may need to utilize the GPU during execution.

An electronic device may execute a program to present graphics content on a display. For example, an electronic device may execute a user interface application, video game application, and the like.

SUMMARY

The following presents a simplified summary of one or more aspects in order to provide a basic understanding of such aspects. This summary is not an extensive overview of all contemplated aspects, and is intended to neither identify key elements of all aspects nor delineate the scope of any or all aspects. Its sole purpose is to present some concepts of one or more aspects in a simplified form as a prelude to the more detailed description that is presented later.

In an aspect of the disclosure, a method, a computer-readable medium, and an apparatus are provided. The apparatus may be an application processor (AP), a display processing unit (DPU), a display engine, a GPU, a CPU, or some other processor for display or graphics processing. In some aspects, the apparatus can measure at least one panel including one or more panel measurements. The apparatus can also determine at least one correction factor for each of the one or more panel measurements. The apparatus can also calculate the at least one correction factor for each of the one or more panel measurements. Further, the apparatus can adjust the at least one correction factor based on each of the one or more panel measurements. In some aspects, the apparatus can compress the at least one correction factor based on each of the one or more panel measurements. Also, the apparatus can store the compressed at least one correction factor. The apparatus can also decode correction data for at least one frame based on the adjusted at least one correction factor. Moreover, the apparatus can store the decoded correction data for the at least one frame. The apparatus can also communicate the decoded correction data for the at least one frame. The apparatus can also reduce an amount of the correction data when an ambient light level is greater than an ambient light threshold.

The details of one or more examples of the disclosure are set forth in the accompanying drawings and the description below. Other features, objects, and advantages of the disclosure will be apparent from the description and drawings, and from the claims.

DETAILED DESCRIPTION

Figure 1:
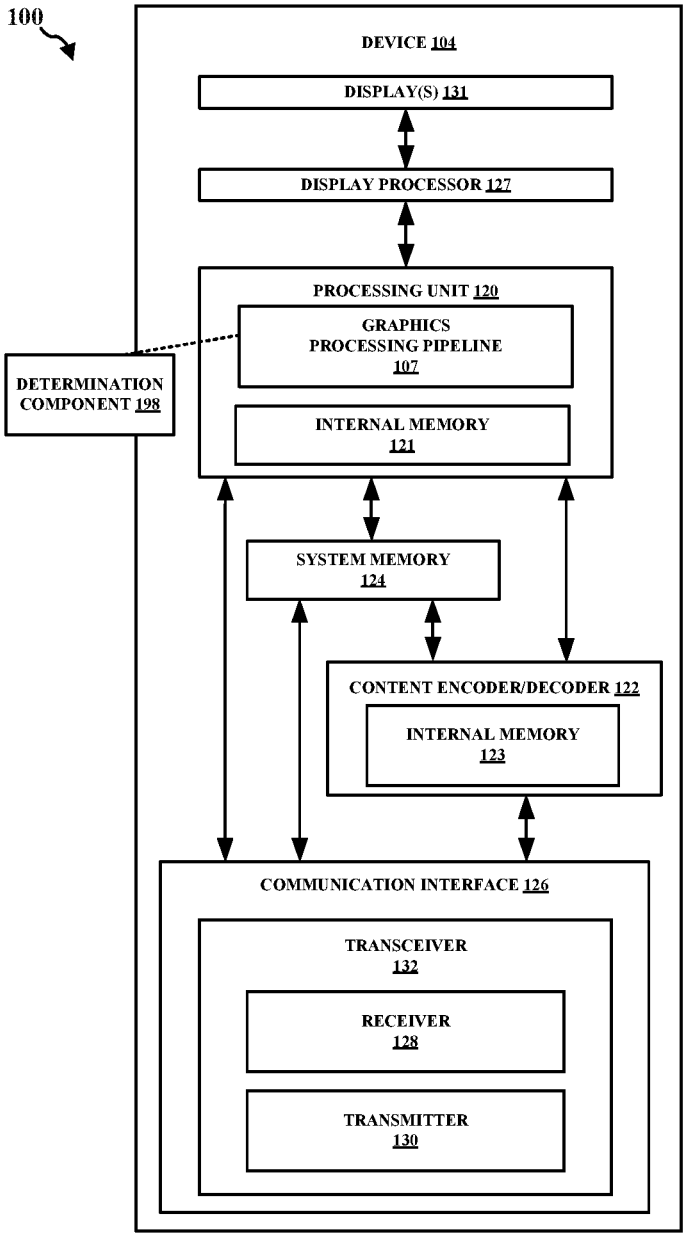
FIG. 1 is a block diagram that illustrates an example content generation system in accordance with one or more techniques of this disclosure.

A number of different de-mura architectures, e.g., display driver integrated circuit (IC) (DDIC) de-mura architectures, may include a high BOM cost, as well as utilize a large amount of power. For example, storing data or information on DDIC memory can result in an increased number of components at the device, which corresponds to an increased BOM cost. Based on this, these types of de-mura solutions may result in a reduced performance level. Aspects of the present disclosure can include de-mura architectures and/or solutions that utilize an application processor (AP), i.e., AP-based de-mura architectures. For instance, by moving the de-mura process to the AP, aspects of the present disclosure can reduce the amount of BOM cost and/or reduce the amount of power utilized by the de-mura process. Further, de-mura processes of the present disclosure can increase the performance level of devices. Aspects of the present disclosure can also include a method for calculating and compressing correction factors or correction offsets for an AP-based de-mura solution. By doing so, the BOM cost can be reduced, e.g., by storing correction factors in a system memory, for the AP-based solution. Additionally, AP-based de-mura solutions of the present disclosure can utilize sub-pixel rendering (SPR) data that can result in a corresponding reduction in display bandwidth.

Various aspects of systems, apparatuses, computer program products, and methods are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of this disclosure to those skilled in the art. Based on the teachings herein one skilled in the art should appreciate that the scope of this disclosure is intended to cover any aspect of the systems, apparatuses, computer program products, and methods disclosed herein, whether implemented independently of, or combined with, other aspects of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. Any aspect disclosed herein may be embodied by one or more elements of a claim.

Although various aspects are described herein, many variations and permutations of these aspects fall within the scope of this disclosure. Although some potential benefits and advantages of aspects of this disclosure are mentioned, the scope of this disclosure is not intended to be limited to particular benefits, uses, or objectives. Rather, aspects of this disclosure are intended to be broadly applicable to different wireless technologies, system configurations, networks, and transmission protocols, some of which are illustrated by way of example in the figures and in the following description. The detailed description and drawings are merely illustrative of this disclosure rather than limiting, the scope of this disclosure being defined by the appended claims and equivalents thereof.

Several aspects are presented with reference to various apparatus and methods. These apparatus and methods are described in the following detailed description and illustrated in the accompanying drawings by various blocks, components, circuits, processes, algorithms, and the like (collectively referred to as "elements"). These elements may be implemented using electronic hardware, computer software, or any combination thereof. Whether such elements are implemented as hardware or software depends upon the particular application and design constraints imposed on the overall system.

By way of example, an element, or any portion of an element, or any combination of elements may be implemented as a "processing system" that includes one or more processors (which may also be referred to as processing units). Examples of processors include microprocessors, microcontrollers, graphics processing units (GPUs), general purpose GPUs (GPGPUs), central processing units (CPUs), application processors, digital signal processors (DSPs), reduced instruction set computing (RISC) processors, systems-on-chip (SOC), baseband processors, application specific integrated circuits (ASICs), field programmable gate arrays (FPGAs), programmable logic devices (PLDs), state machines, gated logic, discrete hardware circuits, and other suitable hardware configured to perform the various functionality described throughout this disclosure. One or more processors in the processing system may execute software. Software can be construed broadly to mean instructions, instruction sets, code, code segments, program code, programs, subprograms, software components, applications, software applications, software packages, routines, subroutines, objects, executables, threads of execution, procedures, functions, etc., whether referred to as software, firmware, middleware, microcode, hardware description language, or otherwise. The term application may refer to software. As described herein, one or more techniques may refer to an application, i.e., software, being configured to perform one or more functions. In such examples, the application may be stored on a memory, e.g., on-chip memory of a processor, system memory, or any other memory. Hardware described herein, such as a processor may be configured to execute the application. For example, the application may be described as including code that, when executed by the hardware, causes the hardware to perform one or more techniques described herein. As an example, the hardware may access the code from a memory and execute the code accessed from the memory to perform one or more techniques described herein. In some examples, components are identified in this disclosure. In such examples, the components may be hardware, software, or a combination thereof. The components may be separate components or sub-components of a single component.

Accordingly, in one or more examples described herein, the functions described may be implemented in hardware, software, or any combination thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise a random access memory (RAM), a read-only memory (ROM), an electrically erasable programmable ROM (EEPROM), optical disk storage, magnetic disk storage, other magnetic storage devices, combinations of the aforementioned types of computer-readable media, or any other medium that can be used to store computer executable code in the form of instructions or data structures that can be accessed by a computer.

In general, this disclosure describes techniques for having a graphics processing pipeline in a single device or multiple devices, improving the rendering of graphical content, and/or reducing the load of a processing unit, i.e., any processing unit configured to perform one or more techniques described herein, such as a GPU. For example, this disclosure describes techniques for graphics processing in any device that utilizes graphics processing. Other example benefits are described throughout this disclosure.

As used herein, instances of the term "content" may refer to "graphical content," "image," and vice versa. This is true regardless of whether the terms are being used as an adjective, noun, or other parts of speech. In some examples, as used herein, the term "graphical content" may refer to a content produced by one or more processes of a graphics processing pipeline. In some examples, as used herein, the term "graphical content" may refer to a content produced by a processing unit configured to perform graphics processing. In some examples, as used herein, the term "graphical content" may refer to a content produced by a graphics processing unit.

In some examples, as used herein, the term "display content" may refer to content generated by a processing unit configured to perform displaying processing. In some examples, as used herein, the term "display content" may refer to content generated by a display processing unit. Graphical content may be processed to become display content. For example, a graphics processing unit may output graphical content, such as a frame, to a buffer (which may be referred to as a framebuffer). A display processing unit may read the graphical content, such as one or more frames from the buffer, and perform one or more display processing techniques thereon to determine display content and/or generate display content. For example, a display processing unit may be configured to perform composition on one or more rendered layers to generate a frame. As another example, a display processing unit may be configured to compose, blend, or otherwise combine two or more layers together into a single frame. A display processing unit may be configured to perform scaling, e.g., upscaling or downscaling, on a frame. In some examples, a frame may refer to a layer. In other examples, a frame may refer to two or more layers that have already been blended together to form the frame, i.e., the frame includes two or more layers, and the frame that includes two or more layers may subsequently be blended.

FIG. 1 is a block diagram that illustrates an example content generation system 100 configured to implement one or more techniques of this disclosure. The content generation system 100 includes a device 104. The device 104 may include one or more components or circuits for performing various functions described herein. In some examples, one or more components of the device 104 may be components of an SOC. The device 104 may include one or more components configured to perform one or more techniques of this disclosure. In the example shown, the device 104 may include a processing unit 120, and a system memory 124. In some aspects, the device 104 can include a number of optional components, e.g., a communication interface 126, a transceiver 132, a receiver 128, a transmitter 130, a display processor 127, and one or more displays 131. Reference to the display 131 may refer to the one or more displays 131. For example, the display 131 may include a single display or multiple displays. The display 131 may include a first display and a second display. The first display may be a left-eye display and the second display may be a right-eye display. In some examples, the first and second display may receive different frames for presentment thereon. In other examples, the first and second display may receive the same frames for presentment thereon. In further examples, the results of the graphics processing may not be displayed on the device, e.g., the first and second display may not receive any frames for presentment thereon. Instead, the frames or graphics processing results may be transferred to another device. In some aspects, this can be referred to as split-rendering.

The processing unit 120 may include an internal memory 121. The processing unit 120 may be configured to perform graphics processing, such as in a graphics processing pipeline 107. In some examples, the device 104 may include a display processor, such as the display processor 127, to perform one or more display processing techniques on one or more frames generated by the processing unit 120 before presentment by the one or more displays 131. The display processor 127 may be configured to perform display processing. For example, the display processor 127 may be configured to perform one or more display processing techniques on one or more frames generated by the processing unit 120. The one or more displays 131 may be configured to display or otherwise present frames processed by the display processor 127. In some examples, the one or more displays 131 may include one or more of: a liquid crystal display (LCD), a plasma display, an organic light emitting diode (OLED) display, a projection display device, an augmented reality display device, a virtual reality display device, a head-mounted display, or any other type of display device.

Memory external to the processing unit 120, such as system memory 124, may be accessible to the processing unit 120. For example, the processing unit 120 may be configured to read from and/or write to external memory, such as the system memory 124. The processing unit 120 may be communicatively coupled to the system memory 124 over a bus. In some examples, the processing unit 120 may be communicatively coupled to each other over the bus or a different connection.

The internal memory 121 or the system memory 124 may include one or more volatile or non-volatile memories or storage devices. In some examples, internal memory 121 or the system memory 124 may include RAM, SRAM, DRAM, erasable programmable ROM (EPROM), electrically erasable programmable ROM (EEPROM), flash memory, a magnetic data media or an optical storage media, or any other type of memory.

The internal memory 121 or the system memory 124 may be a non-transitory storage medium according to some examples. The term "non-transitory" may indicate that the storage medium is not embodied in a carrier wave or a propagated signal. However, the term "non-transitory" should not be interpreted to mean that internal memory 121 or the system memory 124 is non-movable or that its contents are static. As one example, the system memory 124 may be removed from the device 104 and moved to another device. As another example, the system memory 124 may not be removable from the device 104.

The processing unit 120 may be a central processing unit (CPU), a graphics processing unit (GPU), a general purpose GPU (GPGPU), or any other processing unit that may be configured to perform graphics processing. In some examples, the processing unit 120 may be integrated into a motherboard of the device 104. In some examples, the processing unit 120 may be present on a graphics card that is installed in a port in a motherboard of the device 104, or may be otherwise incorporated within a peripheral device configured to interoperate with the device 104. The processing unit 120 may include one or more processors, such as one or more microprocessors, GPUs, application specific integrated circuits (ASICs), field programmable gate arrays (FPGAs), arithmetic logic units (ALUs), digital signal processors (DSPs), discrete logic, software, hardware, firmware, other equivalent integrated or discrete logic circuitry, or any combinations thereof. If the techniques are implemented partially in software, the processing unit 120 may store instructions for the software in a suitable, non-transitory computer-readable storage medium, e.g., internal memory 121, and may execute the instructions in hardware using one or more processors to perform the techniques of this disclosure. Any of the foregoing, including hardware, software, a combination of hardware and software, etc., may be considered to be one or more processors.

In some aspects, the content generation system 100 can include an optional communication interface 126. The communication interface 126 may include a receiver 128 and a transmitter 130. The receiver 128 may be configured to perform any receiving function described herein with respect to the device 104. Additionally, the receiver 128 may be configured to receive information, e.g., eye or head position information, rendering commands, or location information, from another device. The transmitter 130 may be configured to perform any transmitting function described herein with respect to the device 104. For example, the transmitter 130 may be configured to transmit information to another device, which may include a request for content. The receiver 128 and the transmitter 130 may be combined into a transceiver 132. In such examples, the transceiver 132 may be configured to perform any receiving function and/or transmitting function described herein with respect to the device 104.

Referring again to FIG. 1, in certain aspects, the graphics processing pipeline 107 may include a determination component 198 configured to measure at least one panel including one or more panel measurements. The determination component 198 can also be configured to determine at least one correction factor for each of the one or more panel measurements. The determination component 198 can also be configured to calculate the at least one correction factor for each of the one or more panel measurements. The determination component 198 can also be configured to adjust the at least one correction factor based on each of the one or more panel measurements. The determination component 198 can also be configured to compress the at least one correction factor based on each of the one or more panel measurements. The determination component 198 can also be configured to store the compressed at least one correction factor. The determination component 198 can also be configured to decode correction data for at least one frame based on the adjusted at least one correction factor. The determination component 198 can also be configured to store the decoded correction data for the at least one frame. The determination component 198 can also be configured to communicate the decoded correction data for the at least one frame. The determination component 198 can also be configured to reduce an amount of the correction data when an ambient light level is greater than an ambient light threshold.

As described herein, a device, such as the device 104, may refer to any device, apparatus, or system configured to perform one or more techniques described herein. For example, a device may be a server, a base station, user equipment, a client device, a station, an access point, a computer, e.g., a personal computer, a desktop computer, a laptop computer, a tablet computer, a computer workstation, or a mainframe computer, an end product, an apparatus, a phone, a smart phone, a server, a video game platform or console, a handheld device, e.g., a portable video game device or a personal digital assistant (PDA), a wearable computing device, e.g., a smart watch, an augmented reality device, or a virtual reality device, a non-wearable device, a display or display device, a television, a television set-top box, an intermediate network device, a digital media player, a video streaming device, a content streaming device, an in-car computer, any mobile device, any device configured to generate graphical content, or any device configured to perform one or more techniques described herein. Processes herein may be described as performed by a particular component (e.g., a GPU), but, in further embodiments, can be performed using other components (e.g., a CPU), consistent with disclosed embodiments.

GPUs can process multiple types of data or data packets in a GPU pipeline. For instance, in some aspects, a GPU can process two types of data or data packets, e.g., context register packets and draw call data. A context register packet can be a set of global state information, e.g., information regarding a global register, shading program, or constant data, which can regulate how graphics context will be processed. For example, context register packets can include information regarding a color format. In some aspects of context register packets, there can be a bit that indicates which workload belongs to a context register. Also, there can be multiple functions or programming running at the same time and/or in parallel. For example, functions or programming can describe a certain operation, e.g., the color mode or color format. Accordingly, a context register can define multiple states of a GPU.

Context states can be utilized to determine how an individual processing unit functions, e.g., a vertex fetcher (VFD), a vertex shader (VS), a shader processor, or a geometry processor, and/or in what mode the processing unit functions. In order to do so, GPUs can use context registers and programming data. In some aspects, a GPU can generate a workload, e.g., a vertex or pixel workload, in the pipeline.

Figure 2:
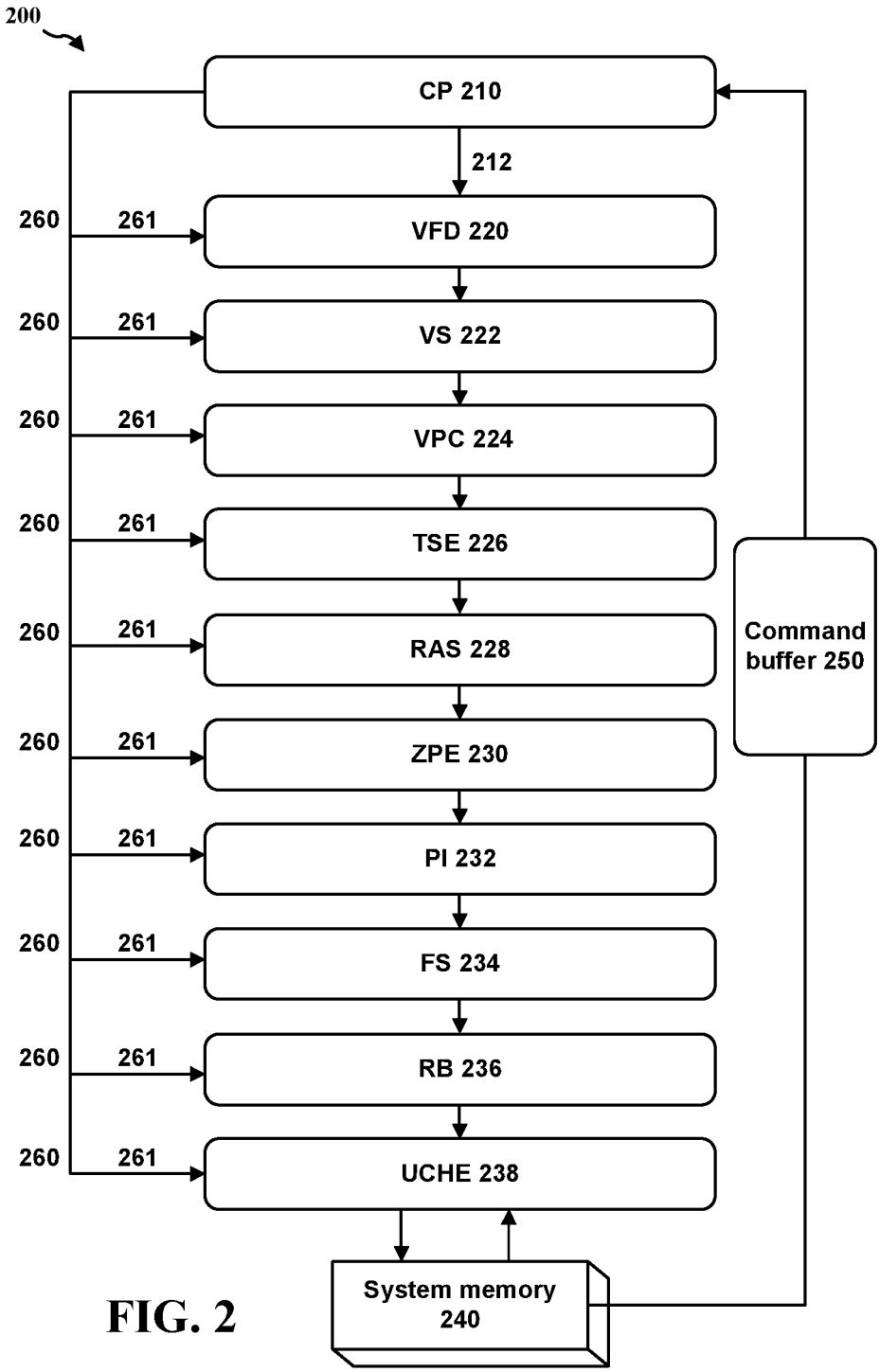
FIG. 2 illustrates an example GPU in accordance with one or more techniques of this disclosure.

FIG. 2 illustrates an example GPU 200 in accordance with one or more techniques of this disclosure. As shown in FIG. 2, GPU 200 includes command processor (CP) 210, draw call data packets 212, VFD 220, VS 222, vertex cache (VPC) 224, triangle setup engine (TSE) 226, rasterizer (RAS) 228, Z process engine (ZPE) 230, pixel interpolator (PI) 232, fragment shader (FS) 234, render backend (RB) 236, L2 cache (UCHE) 238, and system memory 240. Although FIG. 2 displays that GPU 200 includes processing units 220-238, GPU 200 can include a number of additional processing units. Additionally, processing units 220-238 are merely an example and any combination or order of processing units can be used by GPUs according to the present disclosure. GPU 200 also includes command buffer 250, context register packets 260, and context states 261.

As shown in FIG. 2, a GPU can utilize a CP, e.g., CP 210, or hardware accelerator to parse a command buffer into context register packets, e.g., context register packets 260, and/or draw call data packets, e.g., draw call data packets 212. The CP 210 can then send the context register packets 260 or draw call data packets 212 through separate paths to the processing units or blocks in the GPU. Further, the command buffer 250 can alternate different states of context registers and draw calls. For example, a command buffer can be structured as follows: context register of context N, draw call(s) of context N, context register of context N+1, and draw call(s) of context N+1.

Aspects of mobile devices or smart phones can utilize buffer mechanisms to distribute or coordinate a buffer between an application rendering side of the device, e.g., a GPU or CPU, and a display or composition side of the device, e.g., a display engine. For instance, some mobile devices can utilize a buffer queue mechanism to distribute or coordinate a buffer between an application rendering side and a display or composition side, which can include an application processor (AP) or buffer compositor, e.g., a surface flinger or hardware composer (HWC). In some aspects, the application rendering side can be referred to as a producer, while the display or composition side can be referred to as a consumer. Additionally, a synchronization divider or fence can be used to synchronize content between the application rendering side and the display or composition side. Accordingly, a fence can be referred to as a synchronization divider, and vice versa.

A variety of factors can be performance indicators for display processing between an application rendering side and a display or composition side. For instance, frames per second (FPS) and janks, i.e., delays or pauses in frame rendering or composition, can be performance indicators. In some aspects, a jank can be a perceptible pause in the rendering of a software application's user interface. In some applications, janks can be the result of a number of factors, such as slow operations or poor interface design. In some instances, a jank can also correspond to a change in the refresh rate of the display at the device. Janks can also impact a user experience.

In some instances, applications can run at a variety of different FPS modes. In some aspects, displays can run at 30 FPS mode. In other aspects, applications can run at different FPS modes, e.g., 20 or 60 FPS. Aspects of the present disclosure can include a current frame latency time, which can refer to the time difference between when a previous frame completes rendering a current frame completes rendering. The frame latency time can also refer to the time between successive refreshing frames. The frame latency time can also be based on a frame rate. For instance, the frame latency time for each frame can be 33.33 ms (e.g., corresponding to 30 FPS), 16.67 ms (e.g., corresponding to 60 FPS), or 50 ms (e.g., corresponding to 20 FPS).

The market share for displays or panels utilizing organic light emitting diodes (OLEDs) has been steadily increasing. For instance, an increasing amount of OLED displays are being used in high-tier smartphones or smart devices, as well as mid-tier smartphones or even low-tier smartphones. This increasing OLED popularity is due to a number of different reasons, such as OLED's excellent color gamut and near-infinite contrast ratio. However, OLED panels may include significantly more display processing when compared with liquid crystal display (LCD) panels due to non-uniformities in the OLED materials and/or the manufacturing process. These non-uniformities can be referred to as "mura." These non-uniformities can also be corrected in a process known as "de-mura."

De-mura processes can increase the luminance uniformity of OLED panels, as each pixel in an OLED panel may not be the same brightness or luminance when compared to other pixels. For instance, in de-mura processes, each pixel or sub-pixel can be measured for its brightness. Then the pixels or sub-pixels can be corrected to make the pixels a uniform brightness level. As such, de-mura processes can increase the panel uniformity in OLED panels.

In some instances, de-mura solutions can be integrated into the panel display driver integrated circuit (IC) (DDIC). These DDICs can power the display panel. DDIC based de-mura solutions can have a number of different components. For example, DDIC based solutions may utilize flash memory on the DDIC to store any de-mura corrections. This can increase the amount of components or parts utilized by the device or panel, especially compared to storing de-mura corrections on a system memory. In turn, the cost for the bill of materials (BOM) can increase, as the amount of components utilized by the DDIC and the BOM cost can be directly correlated.

Additionally, DDIC-based de-mura solutions may transmit or send fully sampled image data to the DDIC. By doing so, DDIC-based solutions may utilize a larger amount of display bandwidth compared to other de-mura solutions. Further, frame buffer specifications for display stream compression (DSC) or video electronics standards association (VESA) display compression-M (VDC-M) may be larger due to compression ratios. Moreover, the process node of the DDIC may be larger compared to other de-mura solutions, e.g., a process node for a DDIC may be 28 nm or higher at the same time an AP is using a 7 nm process. This can also increase the BOM cost and/or reduce performance levels.

Figure 3:
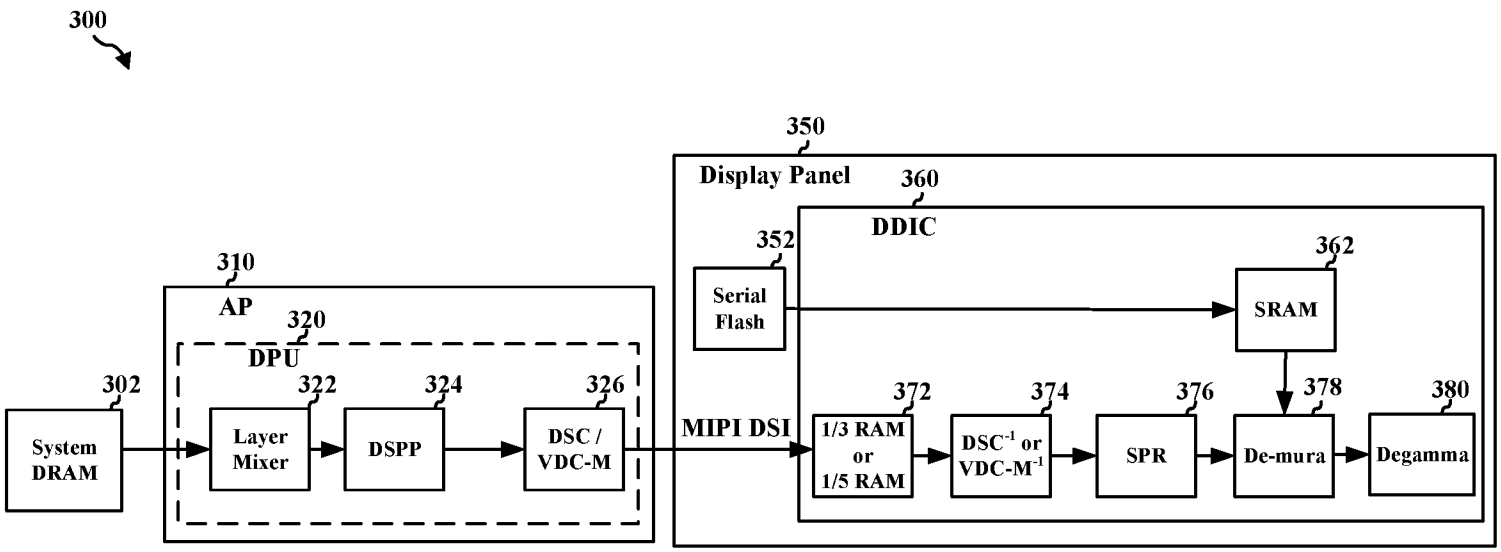
FIG. 3 illustrates an example system architecture in accordance with one or more techniques of this disclosure.

FIG. 3 illustrates system architecture 300 in accordance with one or more techniques of this disclosure. As shown in FIG. 3, system architecture 300 includes system dynamic random access memory (DRAM) 302, application processor (AP) 310, display processing unit (DPU) 320 including layer mixer 322, destination surface processor pipes (DSPP) 324, and display stream compression (DSC) or VDC-M encoder 326. System architecture 300 also includes display panel 350, serial flash memory 352, DDIC 360 including static RAM (SRAM) 362, ⅓ RAM or ⅕ RAM 372, $DSC^{-1}$ or $VDC\text{-}M^{-1}$ decoder 374, sub-pixel rendering (SPR) unit 376, de-mura unit 378, and degamma unit 380.

As shown in FIG. 3, system DRAM 302 may send data or communicate with layer mixer 322, which can communicate data to DSPP 324. Also, DSPP 324 can communicate with DSC or VDC-M encoder 326. In turn, DSC or VDC-M encoder 326 can communicate data, e.g., mobile industry processor interface (MIPI) display serial interface (DSI) data, to a frame buffer on a decoder side (⅓ RAM or ⅕ RAM) 372. Additionally, ⅓ RAM or ⅕ RAM 372 can communicate with $DSC^{-1}$ or $VDC\text{-}M^{-1}$ decoder 374, which can communicate with SPR unit 376. SPR unit 376 can communicate data to de-mura unit 378, which can communicate with degamma unit 380. Moreover, serial flash memory 352 can communicate with SRAM 362, and SRAM 362 can communicate with de-mura unit 378.

FIG. 3 displays that system architecture 300 can include a large amount of components or parts utilized by the AP 310 and display panel 350. Accordingly, the BOM cost for system architecture 300 can be large compared to other types of de-mura solutions. As indicated above, system architecture 300 can utilize a DDIC-based de-mura architecture.

As indicated above, DDIC-based de-mura solutions may utilize a high BOM cost, as well as utilize a high amount of power, e.g., compared to other types of de-mura solutions. For example, storing data or information at the memory on the DDIC can result in an increased number of components at the device, as well as an increased BOM cost. Based on this, DDIC-based de-mura solutions may result in a reduced performance level. Accordingly, there is a present need for de-mura architectures and solutions that reduce the amount of BOM cost and/or reduce the amount of power utilized, such that the performance level of the device may be increased.

Aspects of the present disclosure can include de-mura architectures and solutions that utilize an application processor (AP). AP-based de-mura solutions according to the present disclosure can have a number of advantages compared to a DDIC-based solutions. For instance, by moving the de-mura process to the AP, aspects of the present disclosure can reduce the amount of BOM cost and/or reduce the amount of power utilized by the de-mura process. Further, de-mura processes of the present disclosure can increase the performance level of devices.

Aspects of the present disclosure can also include a method for calculating and compressing correction factors or correction offsets for an AP-based de-mura solution. By doing so, the BOM cost can be reduced, e.g., by storing corrections in a system memory, for the AP-based solution. Additionally, in AP-based de-mura solutions of the present disclosure, SPR rendered data can be utilized. By transmitting SPR data, aspects of the present disclosure can include a corresponding reduction in display bandwidth, e.g., a 33% reduction in display bandwidth.

Additionally, aspects of the present disclosure can utilize higher compression ratios to further ease frame buffer specifications, e.g., for DSC or VDC-M display stream compression. AP-based de-mura solutions can also reduce the BOM cost and increase display performance based on the process node of the AP. For example, the process node of the AP can be smaller, e.g., 7 nm, compared to a DDIC's process node, e.g., 28 nm or higher.

Figure 4:
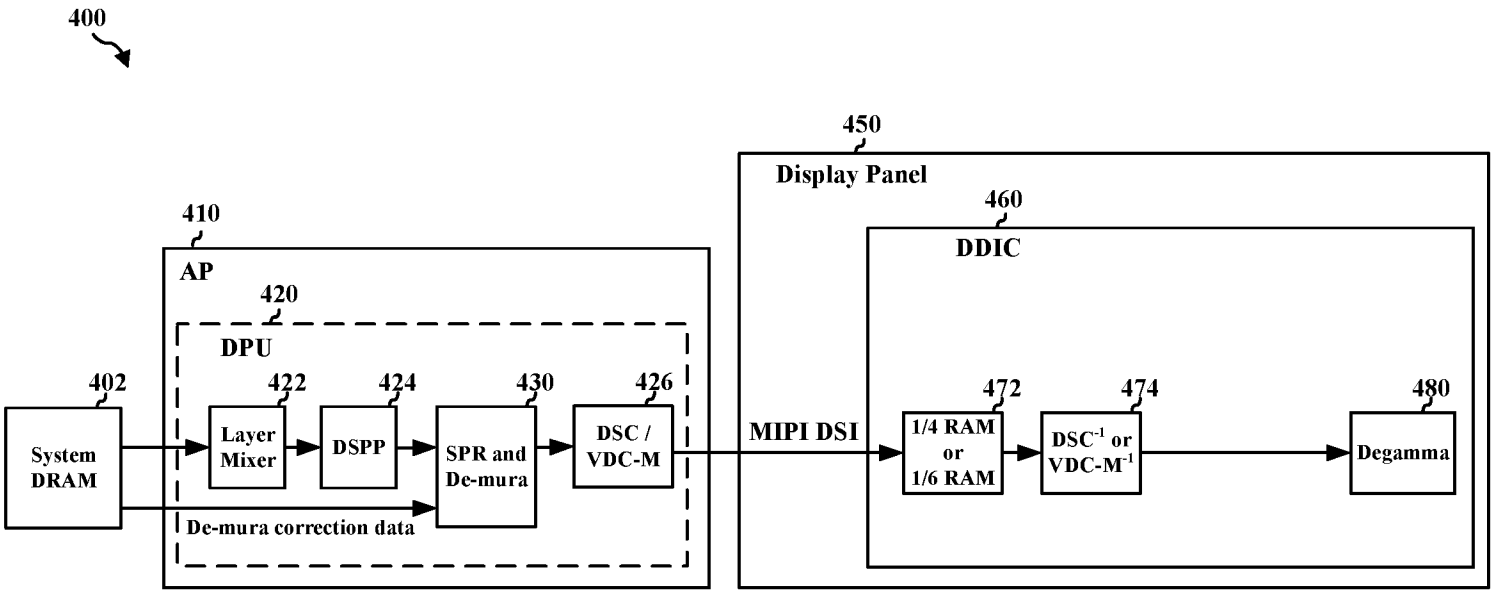
FIG. 4 illustrates an example system architecture in accordance with one or more techniques of this disclosure.

FIG. 4 illustrates system architecture 400 in accordance with one or more techniques of this disclosure. As shown in FIG. 4, system architecture 400 includes system DRAM 402, AP 410, DPU 420 including layer mixer 422, DSPP 424, DSC or VDC-M encoder 426, and SPR and de-mura unit 430. System architecture 400 also includes display panel 450 and DDIC 460 including ¼ RAM or ⅙ RAM 472, DSC' or $VDC\text{-}M^{-1}$ decoder 474, and degamma unit 480.

As shown in FIG. 4, system DRAM 402 may send data or communicate with layer mixer 422, which can communicate with DSPP 424. DSPP 424 can communicate data with SPR and de-mura unit 430, which can communicate with DSC or VDC-M encoder 426. In turn, DSC or VDC-M encoder 426 can communicate data, e.g., MIPI DSI data, to ¼ RAM or ⅙ RAM 472. In some aspects, the DSC or VDC-M encoder 426 can communicate a compressed bit stream, e.g., a ⅔ sampled SPR compressed bit stream. Additionally, ¼ RAM or ⅙ RAM 472 can communicate with $DSC^{-1}$ or $VDC\text{-}M^{-1}$ decoder 474, which can communicate with degamma unit 480.

FIG. 4 displays that system architecture 400 can include a reduced amount of components or parts utilized by the AP 410 and display panel 450, as compared to system architecture 300 in FIG. 3. Accordingly, the BOM cost for system architecture 400 can be reduced compared to system architecture 300 or other DDIC-based de-mura architecture. As shown in FIG. 4 system architecture 400 can utilize an AP-based de-mura architecture.

As compared to system architecture 300 in FIG. 3, system architecture 400 in FIG. 4 can remove a number of components. For example, compared to system architecture 300, system architecture 400 removes the serial flash memory 352 and the SRAM 362. Further, system architecture 400 combines the SPR unit 376 and the de-mura unit 378 into SPR and de-mura unit 430. As indicated above, reducing the amount of components in system architecture 400 can result in a corresponding reduction in BOM cost.

In addition to reducing the BOM cost, system architecture 400 can reduce the amount of system power utilized. For example, compared to the system architecture 300 in FIG. 3 above, the system architecture 400 in FIG. 4 can reduce both the system power and the BOM cost. For instance, system architecture 400 reduces the amount of memory utilized at the DDIC, e.g., DDIC 460, and can move it to the AP, e.g., AP 410. Also, system architecture 400 can reduce the amount of data transferred between the AP 410 or DPU 420 and the display panel 450 or DDIC 460.

In some aspects, system architecture 400 can store a number of correction factors or correction offsets at the AP 410. By doing so, this can reduce power utilized at the DDIC 460. Additionally, the logic of applying the correction factors or correction offsets can be performed on the AP 410, which can also save power due to the smaller process node utilized by the AP.

As shown in FIG. 4, de-mura processes according to the present disclosure can also measure the display panel using a measurement system. For example, the measurement system may be a camera, an imaging photometer, or an imaging colorimeter. FIG. 4 also displays that de-mura correction data can be transferred from the system DRAM 402 to the SPR and de-mura unit 430.

In some aspects, a set of test patterns can be displayed on the display panel. Also, each sub-pixel on the display panel can be measured for a variety of test patterns. In some aspects, the test patterns may include a number of constant images at different levels. This data can then be fed to an algorithm, which can compute an optimal de-mura offset for each sub-pixel at each level.

These de-mura offsets can be utilized by the present disclosure in order to improve the brightness uniformity of each sub-pixel. In some instances, the bandwidth needed to store this de-mura offset data may be large. In order to reduce the data size of the de-mura offsets, aspects of the present disclosure can utilize a machine-learning technique known as clustering, e.g., via the use of clustering algorithms.

Figure 5:
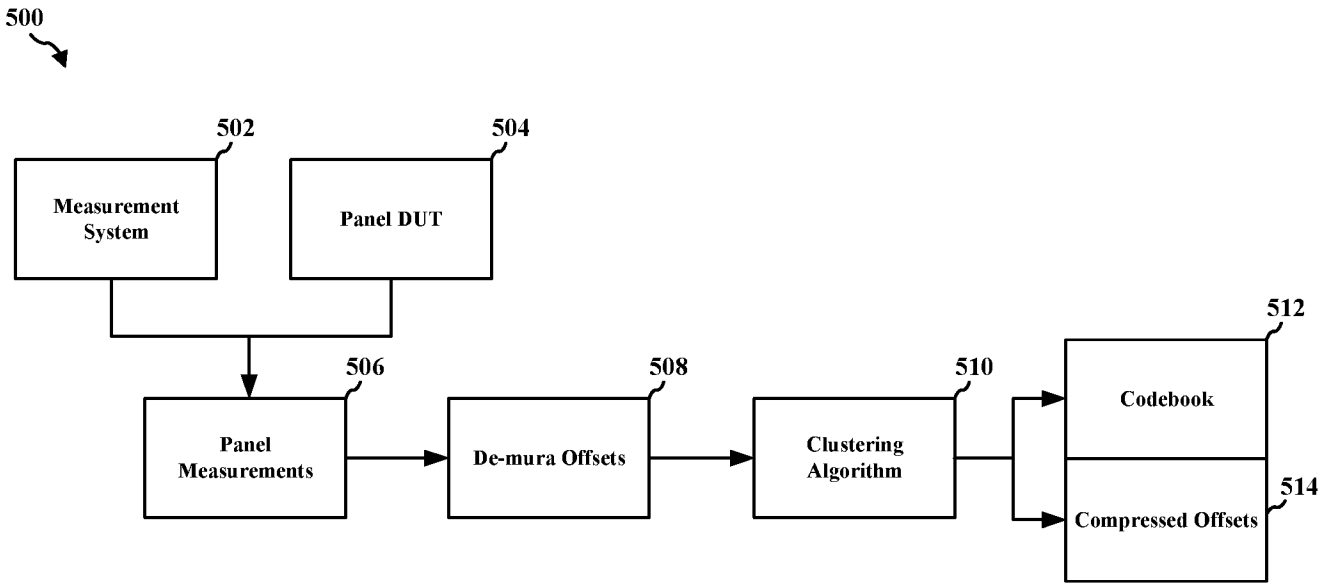
FIG. 5 illustrates an example diagram in accordance with one or more techniques of this disclosure.

FIG. 5 illustrates diagram 500 in accordance with one or more techniques of this disclosure. More specifically, FIG. 5 displays a diagram for the compression of de-mura offsets, which can be an AP-based de-mura solution performed on a DPU. As shown in FIG. 5, diagram 500 includes measurement system 502, panel or device under test (DUT) 504, panel measurements 506, de-mura offsets 508, clustering algorithm 510, codebook 512, and compressed offsets 514.

In some aspects, a device under test (DUT), e.g., DUT 504, can be a particular instance of a display panel, e.g., panel 504.

As shown in FIG. 5, measurement system 502 can measure panel or DUT 504. This can result in panel measurements 506. In some aspects, the measurement system can be a camera. After this, aspects of the present disclosure can calculate de-mura offsets 508. Next, aspects of the present disclosure can utilize clustering algorithm 510, which can result in codebook 512 and compressed offsets 514.

Aspects of the present disclosure can measure a number of different factors of the display panel. For example, aspects of the present disclosure can measure the panel based on three color levels, e.g., red (R), green (G), and blue (B) (RGB), with a number of bits per color level, e.g., 8 bits. Also, each measurement can include a luminance value, e.g., a luminance value for each pixel or sub-pixel.

Aspects of the present disclosure can also calculate de-mura offsets, e.g., de-mura offsets 508, for each pixel or sub-pixel. As indicated above, there may be a variation between the luminance level emitted by each pixel or sub-pixel. If a pixel or sub-pixel is emitting a high or low luminance level compared to other pixels or sub-pixels, aspects of the present disclosure can apply an offset to the pixel or sub-pixel, e.g., de-mura offsets 508. These offsets can be included in one or more sets of data.

Aspects of the present disclosure can also compress the data, e.g., by using clustering algorithm 510. For instance, data can be compressed by quantizing the amount of luminance offset for each pixel or sub-pixel, such as via a clustering algorithm. This can reduce the amount of bandwidth needed to perform the de-mura offset. So in order to reduce the size of the de-mura offsets, aspects of the present disclosure can leverage a machine-learning technique known as clustering.

In some aspects, the clustering algorithm 510 can be a K-means clustering algorithm.

K-means is an iterative algorithm which can determine a set of centroids which can represent data. This K-means clustering algorithm can be performed in any dimensionality, and can be referred to as vector quantization when the dimension is larger than a certain size, e.g., larger than two dimensions. In some aspects, the dimensionality can be the number of levels at which the offsets are computed. For example, if there are offsets at eight different levels, then the K-means algorithm can be an 8-dimensional clustering operation. This means that each centroid may also be eight dimensions. Further, by compressing or quantizing this data, aspects of the present disclosure can reduce the amount of power needed to perform the de-mura offset.

As shown in FIG. 5, the clustering algorithm 510 can generate two outputs, e.g., a codebook 512 and a set of compressed offsets 514. In some instances, the codebook 512 can be constructed from centroids of the clustering process. For instance, the centroids can include a representation or estimation of the data for each pixel or sub-pixel. The codebook 512 can also be a type of database. For example, there can be a number of codebooks that include different RGB color information.

The compressed offsets 514 can be an index of the centroids of the clustering process, e.g., for each data sample. For example, the index can point to the codebook 512. The compressed offsets 514 can also include different RGB color information. Additionally, the compressed offsets 514 can be a code word.

The codebook 512 or compressed offsets 514 can be used to adjust the pixel luminance of a display panel. For instance, the codebook 512 or compressed offsets 514 can be encoded prior to collecting de-mura correction data for a frame, e.g., for each pixel or sub-pixel in a frame. Aspects of the present disclosure can also decode or decipher de-mura correction data for a frame based on the codebook value or the compressed offsets value. As such, the codebook can act as a lookup table for de-mura correction data for each pixel or sub-pixel in a frame. Aspects of the present disclosure can also store the decoded correction data for the frame.

Additionally, aspects of the present disclosure can reduce an amount of the correction data, e.g., when an ambient light level is greater than an ambient light threshold. In some aspects, the amount of correction data can be reduced based on a device power level or a display brightness level. Moreover, the decoded correction data can be based on display content of the display panel, as well as a color gamut for the display panel.

FIGS. 4 and 5 illustrate examples of the aforementioned AP-based de-mura offset processes for reducing memory bandwidth and/or reducing the amount of power utilized. As shown in FIGS. 4 and 5, aspects of the present disclosure, e.g., APs and DPUs herein, can perform a number of different steps or processes to perform the de-mura offset. Although APs and DPUs can perform the de-mura offsets mentioned herein, a number of other components can also perform these steps. For instance, a number of different steps, e.g., the panel measurement or calculation/compression of offsets, may be performed external to the AP or DPU. In some aspects, these steps may be performed by a system or measurement system, e.g., a computer, a PC, or a smartphone, that is connected to the AP, DPU, or other measurement equipment.

As indicated above, systems herein can measure at least one panel, e.g., panel 504, including one or more panel measurements, e.g., panel measurements 506. Systems herein can also determine at least one correction factor, e.g., de-mura offsets 508, for each of the one or more panel measurements, e.g., panel measurements 506. Systems herein can also calculate the at least one correction factor, e.g., de-mura offsets 508, for each of the one or more panel measurements, e.g., panel measurements 506.

Further, systems herein can adjust the at least one correction factor, e.g., via clustering algorithm 510, based on each of the one or more panel measurements, e.g., panel measurements 506. In some aspects, systems herein can compress the at least one correction factor, e.g., via clustering algorithm 510, based on each of the one or more panel measurements, e.g., panel measurements 506. Also, systems herein can store the compressed at least one correction factor, e.g., compressed offsets 514.

In some aspects, the compressed at least one correction factor, e.g., compressed offsets 514, can correspond to at least one codebook, e.g., codebook 512, or at least one lookup table. Further, the compressed at least one correction factor, e.g., compressed offsets 514, can be stored in read-only memory (ROM) or non-volatile memory. Additionally, the at least one correction factor can be compressed based on a clustering algorithm, e.g., clustering algorithm 510.

APs and DPUs herein, e.g., AP 410 or DPU 420, can also decode correction data for at least one frame based on the adjusted at least one correction factor, e.g., compressed offsets 514. Moreover, APs and DPUs herein, e.g., AP 410 or DPU 420, can store the decoded correction data for the at least one frame, e.g., store de-mura correction data at system DRAM 402. APs and DPUs herein, e.g., AP 410 or DPU 420, can also communicate the decoded correction data for the at least one frame, e.g., communicate de-mura correction data from system DRAM 402 to SPR and de-mura unit 430. In some aspects, the decoded correction data, e.g., de-mura correction data, can be based on display content of the at least one panel, e.g., display panel 450, or a color gamut of the at least one panel, e.g., display panel 450.

APs and DPUs herein can also reduce an amount of the correction data, e.g., de-mura correction data, when an ambient light level is greater than an ambient light threshold. In some instances, the amount of correction data, e.g., de-mura correction data, can be reduced based on a device power level or a display brightness level. Further, the at least one correction factor, e.g., de-mura offsets 508, can be calculated based on at least one quantized vector.

In some aspects, the at least one correction factor, e.g., de-mura offsets 508, can be at least one of a de-mura offset or a de-mura gain. The at least one correction factor, e.g., de-mura offsets 508, can also be determined by at least one of an AP or a DPU, e.g., AP 410 or DPU 420. Also, each of the one or more panel measurements, e.g., panel measurements 506, can include a pixel luminance level. Each of the one or more panel measurements, e.g., panel measurements 506, can also correspond to at least one sub-pixel. Moreover, the at least one panel can be a device under test (DUT), e.g., DUT 504.

In some aspects, use cases of the present disclosure can include a de-mura process defined at different levels, e.g., five levels, with a number of bits of precision for the offset at each level, e.g., 8 bits of precision. For example, offsets may be in the form [−128, +127]. This can result in a total of 40 bits of information per sample to describe all offsets. Aspects of the present disclosure can perform clustering for all samples within a color component to determine a set of centroids, e.g., 64 centroids, which best fit the data. So rather than being represented by five 8-bit offsets, each sample can be represented by the index of the centroid to which it belongs. This can produce a certain effective compression ratio, e.g., an effective compression ratio of (40 bits/6 bits) or 6.67:1.

TABLE 1

| Offset (decimal) | Offset (binary) |
|---|---|
| +3 | 0b00000011 |
| 0 | 0b00000000 |
| −100 | 0b10011100 |

Table 1 above shows an example of de-mura offsets in decimal and binary. As indicated in Table 1, codebook entries can be constructed by concatenating the bits of the constituent offsets. For example, a solution can be defined at three levels with 8 bits per level. For a centroid with offsets (+3, 0, −100), the codebook entry may be 0b10011100000000000000000011=47000003. In some instances, de-mura hardware of the present disclosure can use bit shifts in order to recover individual levels from a given code word.

Aspects of the present disclosure can also include additional use cases for power savings. For instance, from an AP-based systems perspective, DRAM bandwidth may be a large factor in power usage. Aspects of the present disclosure can make a number of trade-offs between de-mura performance and DRAM bandwidth. For example, under high ambient light, aspects of the present disclosure can use fewer bits of correction, as the perceivable contrast may be reduced in this scenario, which can save power utilized. So in a high ambient light environment, aspects of the present disclosure can reduce the amount of correction bits. In a dark environment, it may be easy to view the details of the display panel, so the present disclosure may use a high amount of correction bits. However, in a bright environment, it may be difficult to distinguish the details of the display, so the present disclosure may reduce the amount of correction bits.

Also, if a device or smart phone goes into a power saving state, aspects of the present disclosure can reduce the number of bits of correction. Additionally, aspects of the present disclosure can use a smaller de-mura surface based on the flatness or complexity of the content. For instance, for data with a higher complexity, it can be difficult to notice small deviations in the panel. So the number of correction bits may be reduced based on a high complexity of the data. Also, if the content does not include flat surfaces, it may be more difficult to distinguish small panel deviations, so the number of bits can be reduced.

Additionally, aspects of the present disclosure can reduce the number of correction bits per color channel based on a color gamut or the display panel. For instance, if there are more details for a certain color, the number of correction bits can be adjusted. Accordingly, if a display panel user may not notice the benefits of a high number of corrections bits, then the number of corrections bits may be reduced.

Aspects of the present disclosure can also increase color uniformity via the de-mura operations. Accordingly, the color uniformity of display panels can be improved based on the de-mura solutions of the present disclosure. In some aspects, results of the AP-based solution for OLED panels can be color mapped, e.g., based on the measured luminance of the panel. So results of the AP based de-mura solution can be observed in color maps. For instance, aspects of the present disclosure can improve the uniformity for all three color components, e.g., RGB color components.

Aspects of the present disclosure can also include a number of different test measurements for display panels. In one aspect, the panel may be burned-in over a certain time period, e.g., a 72-hour time period, using a specific test pattern. This pattern can be included in the pre-corrected measurement data, which can be a constant pattern at a certain level, e.g., level 16/255. In some aspects, the burn-in artifacts may no longer be visible after the de-mura solution has been applied. Measurements for this result can be taken at a number of different levels, e.g., six levels (16, 32, 64, 128, 192, 255), with different bits of precision for each offset, e.g., 6-bits of precision for each offset [−32, +31]. Accordingly, this can result in a total of 36 bits of information for each sub-pixel. Aspects of the present disclosure can then perform clustering using a certain amount of centroids, e.g., a set of 64 centroids, which can result in a certain amount of data per sub-pixel, e.g., six bits of data per sub-pixel. As indicated above, the present operation can maintain an improved de-mura performance while compressing the offsets by a certain factor, e.g., a factor of 6:1.

Figure 6:
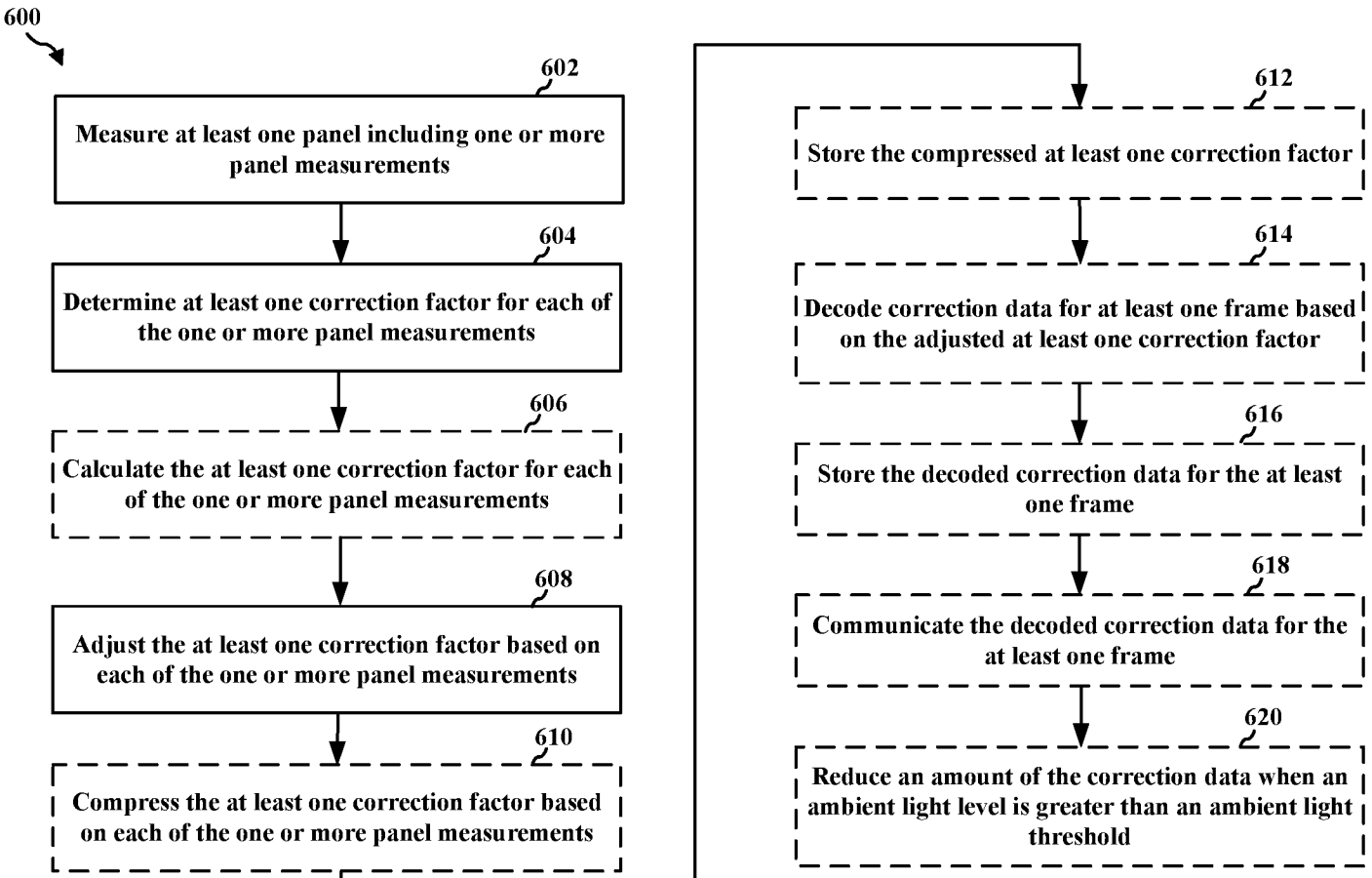
FIG. 6 illustrates an example flowchart of an example method in accordance with one or more techniques of this disclosure.

FIG. 6 illustrates flowchart 600 of an example method in accordance with one or more techniques of this disclosure. The method may be performed by an AP, a DPU, a display engine, a GPU, a CPU, or apparatus for display or graphics processing. At 602, the apparatus can measure at least one panel including one or more panel measurements, as described in connection with the examples in FIGS. 3, 4, and 5. At 604, the apparatus can determine at least one correction factor for each of the one or more panel measurements, as described in connection with the examples in FIGS. 3, 4, and 5. At 606, the apparatus can also calculate the at least one correction factor for each of the one or more panel measurements, as described in connection with the examples in FIGS. 3, 4, and 5.

At 608, the apparatus can adjust the at least one correction factor based on each of the one or more panel measurements, as described in connection with the examples in FIGS. 3, 4, and 5. At 610, the apparatus can compress the at least one correction factor based on each of the one or more panel measurements, as described in connection with the examples in FIGS. 3, 4, and 5. At 612, the apparatus can store the compressed at least one correction factor, as described in connection with the examples in FIGS. 3, 4, and 5.

In some aspects, the compressed at least one correction factor can correspond to at least one codebook or at least one lookup table, as described in connection with the examples in FIGS. 3, 4, and 5. Further, the compressed at least one correction factor can be stored in read-only memory (ROM) or non-volatile memory, as described in connection with the examples in FIGS. 3, 4, and 5. Additionally, the at least one correction factor can be compressed based on a clustering algorithm, as described in connection with the examples in FIGS. 3, 4, and 5.

At 614, the apparatus can decode correction data for at least one frame based on the adjusted at least one correction factor, as described in connection with the examples in FIGS. 3, 4, and 5. At 616, the apparatus can store the decoded correction data for the at least one frame, as described in connection with the examples in FIGS. 3, 4, and 5. At 618, the apparatus can also communicate the decoded correction data for the at least one frame, as described in connection with the examples in FIGS. 3, 4, and 5. In some aspects, the decoded correction data can be based on display content of the at least one panel or a color gamut of the at least one panel, as described in connection with the examples in FIGS. 3, 4, and 5.

At 620, the apparatus can also reduce an amount of the correction data when an ambient light level is greater than an ambient light threshold, as described in connection with the examples in FIGS. 3, 4, and 5. In some instances, the amount of correction data can be reduced based on a device power level or a display brightness level, as described in connection with the examples in FIGS. 3, 4, and 5. Further, the at least one correction factor can be calculated based on at least one quantized vector, as described in connection with the examples in FIGS. 3, 4, and 5.

In some aspects, the at least one correction factor can be at least one of a de-mura offset or a de-mura gain, as described in connection with the examples in FIGS. 3, 4, and 5. The at least one correction factor can also be determined by at least one of an application processor (AP), a display processing unit (DPU), a measurement system, or a CPU, as described in connection with the examples in FIGS. 3, 4, and 5. Also, each of the one or more panel measurements can include a pixel luminance level, as described in connection with the examples in FIGS. 3, 4, and 5. Each of the one or more panel measurements can also correspond to at least one sub-pixel, as described in connection with the examples in FIGS. 3, 4, and 5. Moreover, the at least one panel can be a device under test (DUT), as described in connection with the examples in FIGS. 3, 4, and 5.

In one configuration, a method or apparatus for display or graphics processing is provided. The apparatus may be a measurement system, an AP, a DPU, a display engine, a GPU, a CPU, or some other processor that can perform display or graphics processing. In one aspect, the apparatus may be the processing unit 120 within the device 104, or may be some other hardware within device 104 or another device. The apparatus may include means for measuring at least one panel including one or more panel measurements. The apparatus may also include means for determining at least one correction factor for each of the one or more panel measurements. The apparatus may also include means for adjusting the at least one correction factor based on each of the one or more panel measurements. The apparatus may also include means for compressing the at least one correction factor based on each of the one or more panel measurements. The apparatus may also include means for storing the compressed at least one correction factor. The apparatus may also include means for decoding correction data for at least one frame based on the adjusted at least one correction factor. The apparatus may also include means for communicating the decoded correction data for the at least one frame. The apparatus may also include means for storing the decoded correction data for the at least one frame. The apparatus may also include means for reducing an amount of the correction data when an ambient light level is greater than an ambient light threshold. The apparatus may also include means for calculating the at least one correction factor for each of the one or more panel measurements.

The subject matter described herein can be implemented to realize one or more benefits or advantages. For instance, the described display or graphics processing techniques can be used by measurement systems, APs, DPUs, display engines, GPUs, or CPUs to reduce the processing time and/or power used. This can also be accomplished at a low cost compared to other display or graphics processing techniques. Moreover, the display or graphics processing techniques herein can improve or speed up the processing or execution time. Further, the graphics processing techniques herein can improve the resource or data utilization and/or resource efficiency. Additionally, aspects of the present disclosure can utilize an AP-based architecture to store de-mura data that can reduce memory bandwidth and improve performance during a de-mura calculation and compression process.

In accordance with this disclosure, the term "or" may be interrupted as "and/or" where context does not dictate otherwise. Additionally, while phrases such as "one or more" or "at least one" or the like may have been used for some features disclosed herein but not others, the features for which such language was not used may be interpreted to have such a meaning implied where context does not dictate otherwise.

In one or more examples, the functions described herein may be implemented in hardware, software, firmware, or any combination thereof. For example, although the term "processing unit" has been used throughout this disclosure, such processing units may be implemented in hardware, software, firmware, or any combination thereof. If any function, processing unit, technique described herein, or other module is implemented in software, the function, processing unit, technique described herein, or other module may be stored on or transmitted over as one or more instructions or code on a computer-readable medium. Computer-readable media may include computer data storage media or communication media including any medium that facilitates transfer of a computer program from one place to another. In this manner, computer-readable media generally may correspond to (1) tangible computer-readable storage media, which is non-transitory or (2) a communication medium such as a signal or carrier wave. Data storage media may be any available media that can be accessed by one or more computers or one or more processors to retrieve instructions, code and/or data structures for implementation of the techniques described in this disclosure. By way of example, and not limitation, such computer-readable media can comprise RAM, ROM, EEPROM, CD-ROM or other optical disk storage, magnetic disk storage or other magnetic storage devices. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. A computer program product may include a computer-readable medium.

The code may be executed by one or more processors, such as one or more digital signal processors (DSPs), general purpose microprocessors, application specific integrated circuits (ASICs), arithmetic logic units (ALUs), field programmable logic arrays (FPGAs), or other equivalent integrated or discrete logic circuitry. Accordingly, the term "processor," as used herein may refer to any of the foregoing structure or any other structure suitable for implementation of the techniques described herein. Also, the techniques could be fully implemented in one or more circuits or logic elements.

The techniques of this disclosure may be implemented in a wide variety of devices or apparatuses, including a wireless handset, an integrated circuit (IC) or a set of ICs, e.g., a chip set. Various components, modules or units are described in this disclosure to emphasize functional aspects of devices configured to perform the disclosed techniques, but do not necessarily need realization by different hardware units. Rather, as described above, various units may be combined in any hardware unit or provided by a collection of interoperative hardware units, including one or more processors as described above, in conjunction with suitable software and/or firmware.

Various examples have been described. These and other examples are within the scope of the following claims.

What is claimed is:

1. A method of display processing, comprising:

measuring at least one panel including one or more panel measurements;

determining at least one correction factor for each of the one or more panel measurements;

adjusting the at least one correction factor based on each of the one or more panel measurements; and decoding correction data for at least one frame based on the adjusted at least one correction factor, wherein the decoded correction data is based on display content of the at least one panel or a color gamut of the at least one panel.

2. The method of claim 1, further comprising:

compressing the at least one correction factor based on each of the one or more panel measurements.

3. The method of claim 2, further comprising:

storing the compressed at least one correction factor.

4. The method of claim 3, wherein the compressed at least one correction factor corresponds to at least one codebook or at least one lookup table.

5. The method of claim 3, wherein the compressed at least one correction factor is stored in read-only memory (ROM) or non-volatile memory.

6. The method of claim 2, wherein the at least one correction factor is compressed based on a clustering algorithm.

7. The method of claim 1, further comprising:

storing the decoded correction data for the at least one frame.

8. The method of claim 1, further comprising:
communicating the decoded correction data for the at least one frame.

9. The method of claim 1, further comprising:
reducing an amount of the correction data when an ambient light level is greater than an ambient light threshold.

10. The method of claim 9, wherein the amount of correction data is reduced based on a device power level or a display brightness level.

11. The method of claim 1, further comprising:
calculating the at least one correction factor for each of the one or more panel measurements.

12. The method of claim 11, wherein the at least one correction factor is calculated based on at least one quantized vector.

13. The method of claim 1, wherein the at least one correction factor is at least one of a de-mura offset or a de-mura gain.

14. The method of claim 1, wherein the at least one correction factor is determined by at least one of an application processor (AP), a display processing unit (DPU), a measurement system, or a central processing unit (CPU).

15. The method of claim 1, wherein each of the one or more panel measurements includes a pixel luminance level.

16. The method of claim 1, wherein each of the one or more panel measurements correspond to at least one subpixel.

17. The method of claim 1, wherein the at least one panel is a device under test (DUT).

18. An apparatus for display processing, comprising:
a memory; and
at least one processor coupled to the memory and configured to:
measure at least one panel including one or more panel measurements;
determine at least one correction factor for each of the one or more panel measurements;
adjust the at least one correction factor based on each of the one or more panel measurements; and
decode correction data for at least one frame based on the adjusted at least one correction factor, wherein the decoded correction data is based on display content of the at least one panel or a color gamut of the at least one panel.

19. The apparatus of claim 18, wherein the at least one processor is further configured to: compress the at least one correction factor based on each of the one or more panel measurements.

20. The apparatus of claim 19, wherein the at least one processor is further configured to: store the compressed at least one correction factor.

21. The apparatus of claim 20, wherein the compressed at least one correction factor corresponds to at least one codebook or at least one lookup table.

22. The apparatus of claim 20, wherein the compressed at least one correction factor is stored in read-only memory (ROM) or non-volatile memory.

23. The apparatus of claim 19, wherein the at least one correction factor is compressed based on a clustering algorithm.

24. The apparatus of claim 18, wherein the at least one processor is further configured to:
store the decoded correction data for the at least one frame.

25. The apparatus of claim 18, wherein the at least one processor is further configured to:
communicate the decoded correction data for the at least one frame.

26. The apparatus of claim 18, wherein the at least one processor is further configured to:
reduce an amount of the correction data when an ambient light level is greater than an ambient light threshold.

27. The apparatus of claim 26, wherein the amount of correction data is reduced based on a device power level or a display brightness level.

28. The apparatus of claim 18, wherein the at least one processor is further configured to:
calculate the at least one correction factor for each of the one or more panel measurements.

29. The apparatus of claim 28, wherein the at least one correction factor is calculated based on at least one quantized vector.

30. The apparatus of claim 18, wherein the at least one correction factor is at least one of a de-mura offset or a de-mura gain.

31. The apparatus of claim 18, wherein the at least one correction factor is determined by at least one of an application processor (AP), a display processing unit (DPU), a measurement system, or a central processing unit (CPU).

32. The apparatus of claim 18, wherein each of the one or more panel measurements includes a pixel luminance level.

33. The apparatus of claim 18, wherein each of the one or more panel measurements correspond to at least one subpixel.

34. The apparatus of claim 18, wherein the at least one panel is a device under test (DUT).

35. An apparatus for display processing, comprising:
means for measuring at least one panel including one or more panel measurements;
means for determining at least one correction factor for each of the one or more panel measurements;
means for adjusting the at least one correction factor based on each of the one or more panel measurements; and
means for decoding correction data for at least one frame based on the adjusted at least one correction factor, wherein the decoded correction data is based on display content of the at least one panel or a color gamut of the at least one panel.

36. The apparatus of claim 35, further comprising:
means for compressing the at least one correction factor based on each of the one or more panel measurements.

37. The apparatus of claim 36, further comprising:
means for storing the compressed at least one correction factor.

38. The apparatus of claim 37, wherein the compressed at least one correction factor corresponds to at least one codebook or at least one lookup table.

39. The apparatus of claim 37, wherein the compressed at least one correction factor is stored in read-only memory (ROM) or non-volatile memory.

40. The apparatus of claim 36, wherein the at least one correction factor is compressed based on a clustering algorithm.

41. The apparatus of claim 35, further comprising:
means for storing the decoded correction data for the at least one frame.

42. The apparatus of claim 35, further comprising:
means for communicating the decoded correction data for the at least one frame.

43. The apparatus of claim 35, further comprising:

means for reducing an amount of the correction data when an ambient light level is greater than an ambient light threshold.

44. The apparatus of claim 43, wherein the amount of correction data is reduced based on a device power level or a display brightness level.

45. The apparatus of claim 35, further comprising:

means for calculating the at least one correction factor for each of the one or more panel measurements.

46. The apparatus of claim 45, wherein the at least one correction factor is calculated based on at least one quantized vector.

47. The apparatus of claim 35, wherein the at least one correction factor is at least one of a de-mura offset or a de-mura gain.

48. The apparatus of claim 35, wherein the at least one correction factor is determined by at least one of an application processor (AP), a display processing unit (DPU), a measurement system, or a central processing unit (CPU).

49. The apparatus of claim 35, wherein each of the one or more panel measurements includes a pixel luminance level.

50. The apparatus of claim 35, wherein each of the one or more panel measurements correspond to at least one sub-pixel.

51. The apparatus of claim 35, wherein the at least one panel is a device under test (DUT).

52. A computer-readable medium storing computer executable code for display processing, comprising code to:

measure at least one panel including one or more panel measurements;

determine at least one correction factor for each of the one or more panel measurements;

adjust the at least one correction factor based on each of the one or more panel measurements; and decode correction data for at least one frame based on the adjusted at least one correction factor, wherein the decoded correction data is based on display content of the at least one panel or a color gamut of the at least one panel.

* * * * *